United States Patent [19]

Adam et al.

[11] 4,336,862

[45] Jun. 29, 1982

[54] DEVICE FOR REDUCING THE EMISSION OF NOISE IN BUCKLE FOLDING MACHINES

[75] Inventors: Axel Adam, Backnang-Steinbach; Fritz Heina, Murrhardt, both of Fed. Rep. of Germany

[73] Assignee: Maschinenbau Oppenweiler Binder GmbH & Co., Oppenweiler, Fed. Rep. of Germany

[21] Appl. No.: 274,254

[22] Filed: Jun. 16, 1981

[30] Foreign Application Priority Data

Jul. 3, 1980 [DE] Fed. Rep. of Germany ..... 3025239

[51] Int. Cl.[3] ..... G10K 11/00; B65H 45/14

[52] U.S. Cl. ..... 181/200; 493/420

[58] Field of Search ..... 181/200, 202; 493/419–421

[56] References Cited

FOREIGN PATENT DOCUMENTS 118588 3/1976 German Democratic Rep. .

*Primary Examiner*—L. T. Hix
*Assistant Examiner*—Thomas H. Tarcza
*Attorney, Agent, or Firm*—Harding, Earley, Follmer & Frailey

[57] ABSTRACT

A device for reducing the emission of noise in buckle folding units provided with noise control enclosures, comprising a noise control hood 5 essentially completely enclosing the upper 41 and lower folding pockets 42 and the folding rolls 7, said noise control hood 5 being at least partially slidingly displaceable, tiltable and/or removable and being provided with a slot for the passage of the sheet in the associated hood section, which slot is aligned with the nip of the pair of intake and discharge rolls, respectively, is improved by further reducing the noise emission in the sheet discharge area without influencing dependable function and easy access to this area. This is obtained by the fact that the hood section associated with the pair of discharge rolls 71, 72 comprises a cover plate 10 having a vertical first section 12 secured to the hood and a second section 11 held on the first section 12 pivotably between an inclined closed position adjoining to the hood and an opened position above the folding rolls 7, wherein the longitudinal edges, being parallel to the roll axes, of the discharge slot 15 provided in the vertical section 12 are arranged such as to form noise emission sealing sites in cooperation with the peripheral surfaces of the pair of discharge rolls 71, 72.

3 Claims, 8 Drawing Figures

DEVICE FOR REDUCING THE EMISSION OF NOISE IN BUCKLE FOLDING MACHINES

BACKGROUND OF THE INVENTION

1. Field of the Invention

The present invention relates to a device for reducing the emission of noise in buckle folding units provided with sound-proofing enclosures, comprising a noise control hood essentially completely enclosing the upper and lower folding pockets and the folding rolls, said noise control hood being at least partially slidingly displaceable, pivotable and/or removable and being provided with a slot for the passage of the sheet in the associated hood section, which slot is aligned with the nip of the pair of intake and discharge rolls, respectively.

2. Brief Description of the Prior Art

It has already been known to reduce the noise emitted by buckle folding machines by enclosing the whole folding unit or the noise-emitting part thereof, particularly the upper and lower folding pockets, in a noise control hood which, in order to make its interior accessible, is provided with silding, tilting and/or removable parts and which is lined with noise-absorbing and/or noise-reflecting material. However, it is necessary to provide in the associated hood section a slot in alignment with the nip of the intake and discharge rolls, respectively (East German Pat. No. 118,588; "Der Polygraph", Part 20, 1978, pages 1705, 1706).

In view of the fact that trouble frequently arises in the discharge section of the folding unit, such trouble requiring direct access for correction, it has been customary to provide a relatively large aperture on the discharge end. Attempts to dispose part of the noise control hood at the smallest possible distance from the last folding rolls to be passed by the sheets have shown that this remedy makes it very difficult to install and adjust the knives on the knife shafts which are in many cases disposed downstream of the last pair of folding rolls. Particularly in cases in which a plurality of buckle folding units are arranged in series or in which a buckle folding unit is combined with a plurality of knife folding units disposed downstream thereof it may become impossible to dismantle the knife shafts and to remove them from the machine. Also the removal of sheet material which has become jammed in the machine is difficult because such material is not readily accessible.

This disadvantage is found also in the case of a well-known buckle folding machine (West German provisionally laid out print DE-OS No. 23 61 803), the sheet deflectors of which are held to absorb sound conducted through solids. As the noise can be transferred by the rotation of the folding rolls, particularly by the little grooves thereof, sound absorbing or sound dampening bodies are provided between the last two folding rolls and a pair of further shafts which may be installed stationarily. The discharge slot defined by these bodies converges in the direction toward the further shafts. An integration of these bodies in a noise emission control hood is not shown.

OBJECT OF THE INVENTION

Therefore, it is an object of this invention to modify the device of the type described initially in such a manner that it is possible to attain in the area of the discharge slot an enhanced reduction in the emission of noise of the folding unit with very simple means, maintaining the possibility of easy access to the sheet discharge area.

SUMMARY OF THE INVENTION

Taking a device of the type indicated as a starting point, this object is attained according to the invention in that the hood section associated with the pair of discharge rolls comprises a cover plate having a vertical first section secured to the hood and a second section held on the first section pivotably between an inclined closed position adjoining to the hood and an opened oposition above the folding rolls, wherein the longitudinal edges, being parallel to the roll axes, of the slot provided in the vertical section are arranged such as to form noise emission sealing sites in cooperation with the peripheral surfaces of the pair of discharge rolls.

The device according to the invention has the advantage that the noise emission of the known folding units can be reduced by 3 dB or more in addition to the noise control provided by the noise control hood. Although noise emission sealing sites are provided, the dependable function of the folding rolls is permitted even under the viewpoint of thermal expansion and of the change of the position of the folding rolls caused by different sheet thicknesses. Further the servicing and trouble correcting operations can be performed on the machine parts at the discharge end of the folding machine without any impediment. Usually the sections of the cover plate are lined with a noise-absorbing and/or noise reflecting material. Since the pivotable second section can be tilted, the knife shafts remain accessible from above so that, with the folding pockets withdrawn or removed, the knife shafts may be easily adjusted or dismantled in an upward direction and that trouble correcting operations can be easily performed even in cases in which a plurality of buckle folding units are arranged in series or combined with folding knife units. Moreover, the movable section, when tilted out of its closed position, protects the folding rolls from damage, particularly during removal of the knife shafts carrying cutting, perforating or scoring tools. Moreover, the operating personnel is protected from the drawing-in slots of the folding roll in the event the machine is inadvertently started during assembly operations.

As regards the provision of noise emission seals of the type just described, it has been found convenient to provide additional guide members on the upper and/or lower edge of the discharge slot. Such guide members end immediately adjacent to the pair of rolls associated therewith. This means that the end faces of the guide members which define the discharge slot for the folded sheets are disposed at so small a distance from the last pair of folding rolls that the functon of the pair of rolls is not jeopardized, with the distance, however, being so narrow that the desired noise emission site or line or surface is provided.

BRIEF DESCRIPTION OF THE DRAWINGS

The invention and further particulars will be described more specifically hereinafter with reference to preferred embodiments shown in the drawings, in which.

DETAILED DESCRIPTION OF THE PREFERRED EMBODIMENTS OF THE INVENTION

Figure 1:
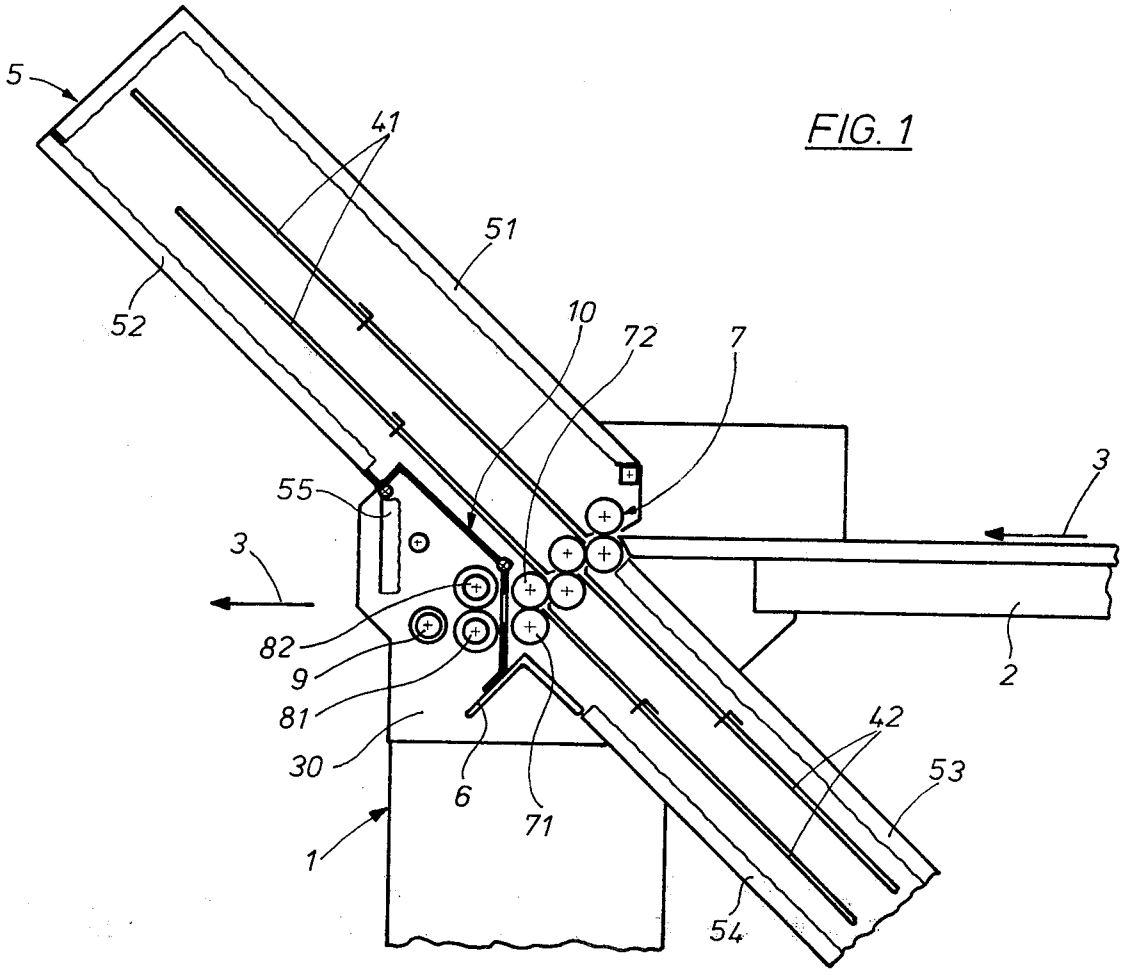
FIG. 1 is a side elevation of a buckle folding machine provided with a device according to the invention.

The buckle folding unit 1 shown in FIG. 1 is supplied with sheets to be folded via an aligning table 2 in the conveying direction indicated by arrow 3. The buckle folding machine includes upper folding pockets 41 and lower folding pockets 42 which are provided with stop members and which are almost completely enclosed in a noise control hood 5, with the bottom 52 of the upper part of noise control hood 5 being provided with a pivotable noise control flap 55 disposed in the vicinity of the folding rolls 7. The cover 51 and the bottom 52 of the upper part of noise control hood 5 are adapted to be slidably displaced or tilted and/or removed. The lower part of noise control hood 5 comprises an upper section 53 and a lower section 54, the two sections enclosing the lower folding pocket 42 and being adapted to be opened partially or completely. Disposed between lower section 54 and the folding rolls 7 is a cross member 6 in the form of an angular section. The last folding roll pair 71, 72 transfers the folded sheets to a knife shaft pair 81, 82 downstream of which (referring to arrow 3 indicating the conveying direction) a ribbon roll 9 is disposed. A cover plate 10 serving to reduce the emission of noise is disposed on the discharge side of the folding rolls 7.

Figure 2:
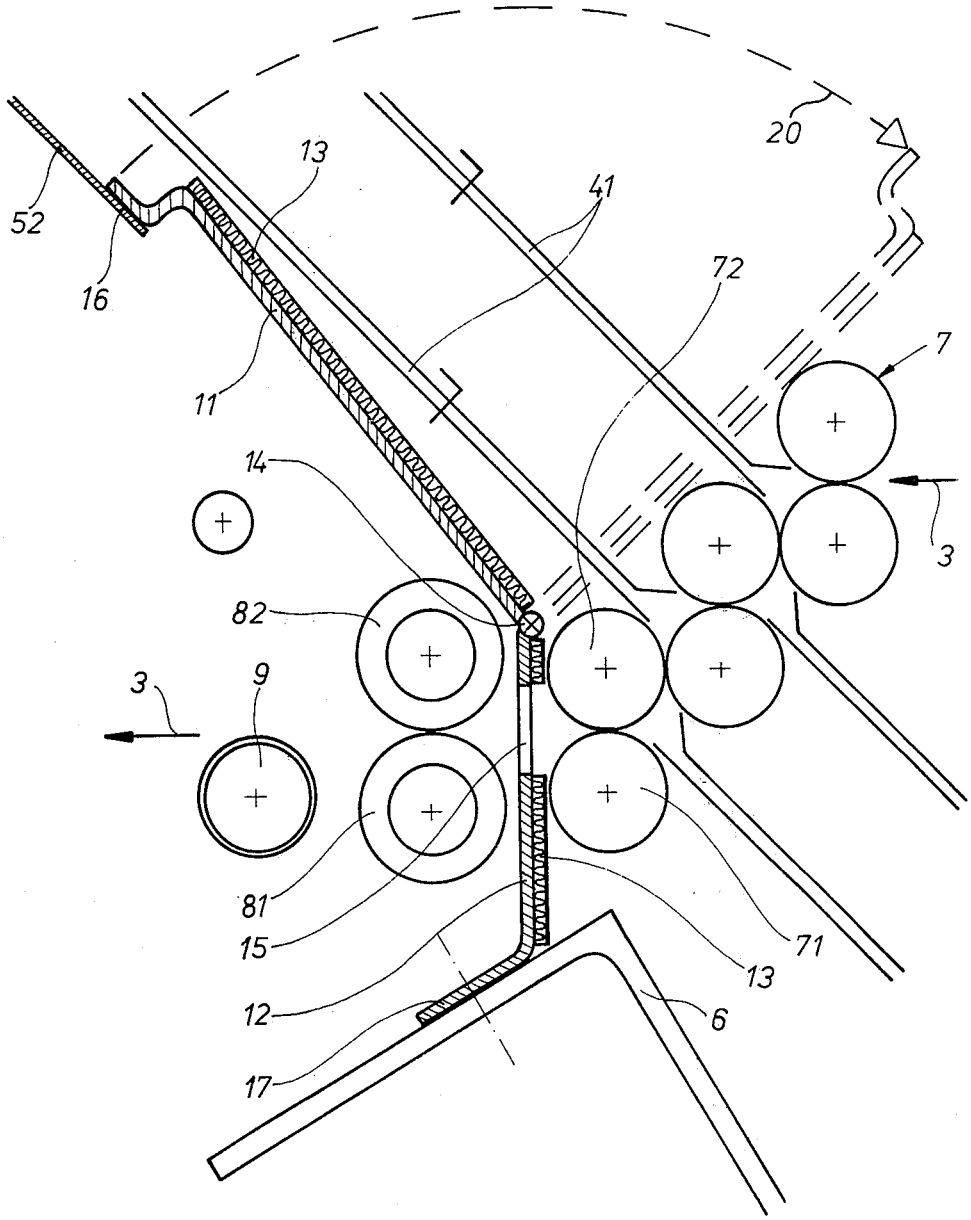
FIG. 2 is an enlarged elevation of certain details of the device of FIG. 1.

As shown in FIG. 2, cover plate 10 is provided with a base portion 17 by means of which the cover plate is secured to the angle section transverse member 6. In addition, cover plate 10 comprises, as an integral part of base section 17, an essentially vertically disposed section 12 which, on the side facing the folding unit, is provided with a lining 13 consisting of a noise absorbing and/or reflecting material. The vertically extending section 12 of cover plate 10 is provided with a discharge slot 15 for the folding sheets, slot 15 being disposed in such a manner that its center line is essentially aligned with the gap defined by conveyor rolls 71 and 72, these rolls being disposed at the smallest possible distance from the noise absorbing and/or noise reflecting lining 13 of cover plate section 12 as is compatible with an unimpeded function of folding rolls 71 and 72 with due consideration being given to expansion phenomena resulting from the structure of the machine and caused by thermal effects as well as to axis displacements resulting from the passage of sheets of varying thickness. Between the longitudinal edges parallel to the folding roll axes of the discharge slot 15 and the peripheral faces of the folding rolls 71 and 72 noise emission sealing sites are formed which serve to provide the desired additional sound-proofing of 3 dB and more. The height of discharge slot 15 is smaller than the vertical spacing of the folding roll axes, but it is sufficient to ensure trouble-free passage of the folded sheets toward knife shafts 81 and 82.

Connected to the vertically extending section 12 of cover plate 10 by means of a hinge 14 is an inclined section 11 of the cover plate which co-operates at 16 with the bottom 52 of the upper section of noise control hood 5 and which is also provided with a lining 13 consisting of a noise absorbing and/or noise reflecting material. After the folding pockets 41 have been withdrawn or removed, the inclined section 11 may be tilted in the direction of arrow 20 towards the folding rolls 7 so as to provide free access to knife shafts 81 and 82 with section 11 at the same time constituting a cover protecting the folding rolls 7.

Figure 3:
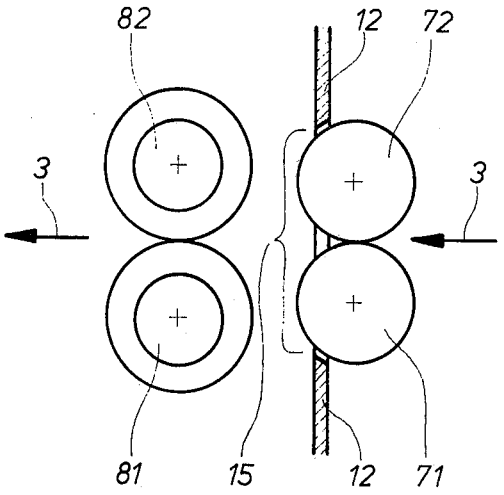
FIG. 3 is a side elevation showing a modification of the arrangement of FIG. 2.

In the embodiment shown in FIG. 3, the height of discharge slot 15 is slightly smaller than twice the distance between the axes of the sheet-discharging folding rolls 71, 72. The longitudinal edges defining the discharge slot 15 of the vertically extending section 12 of cover plate 10 are disposed in the direct vicinity of the peripheral surfaces of said rolls so as to provide the desired additional noise control effect described earlier.

FIGS. 4 to 8 show a number of further embodiments illustrating the large number of possibilities of employing guide members 21 and 22 in order to dispose the above-mentioned noise emission control seals in the desired manner and/or to reduce the tendency of the folded sheets to deviate from the desired direction of feed as well as to limit elastic flexing of the folded sheets. The narrowing of the discharge slot resulting from the converging arrangement of guide members 21 and 22 also tends to reduce the emission of noise.

Figure 4:
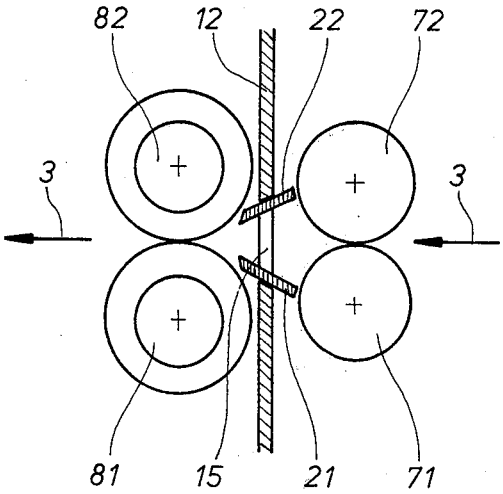

In the embodiment shown in FIG. 4, the guide members 21 and 22 are disposed on the associated longitudinal edge of the discharge slot 15 in such a manner that they project beyond the discharge slot on both sides thereof and that they converge in the direction of sheet travel indicated by arrow 3. The edges of the guide members 21, 22 facing the folding rolls 71, 72 are disposed in the immediate vicinity of the peripheral surfaces of these rolls, this arrangement resulting in the formation of noise emission seals without the function of rolls 71, 72 being impaired. The other edges of the guide members 21, 22 are disposed in the immediate vicinity of knife rolls 81, 82.

Figure 5:
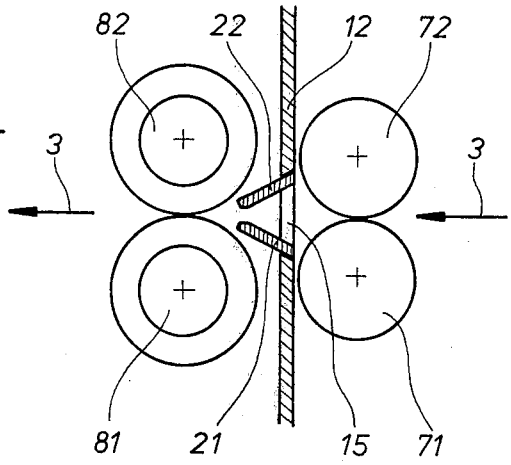

In the embodiment shown in FIG. 5, the guide members 21, 22 resembling those emloyed in the embodiment of FIG. 5 are displaced in the direction of sheet travel (arrow 3) to such an extent that their front edges are aligned with the surface of the vertical cover plate section 12 facing folding rolls 71, 72. In this embodiment, the noise emisson seals proper are disposed between the peripheral surfaces of rolls 71, 72 on the one hand and the longitudinal edges of the discharge slot 15 in the area of the vertical cover plate section 12 on the other hand.

Figure 6:
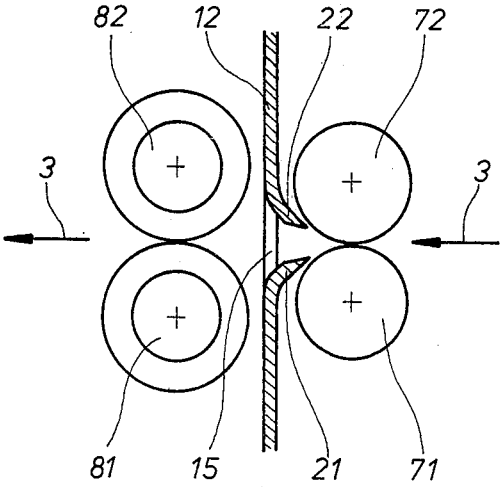

In the embodiment shown in FIG. 6, the guide members 21, 22 extend convergingly towards the discharge slot between folding rolls 71, 72, the result being that the noise emission sealing zones are disposed at a smaller distance from the center line of discharge slot 15.

Figure 7:
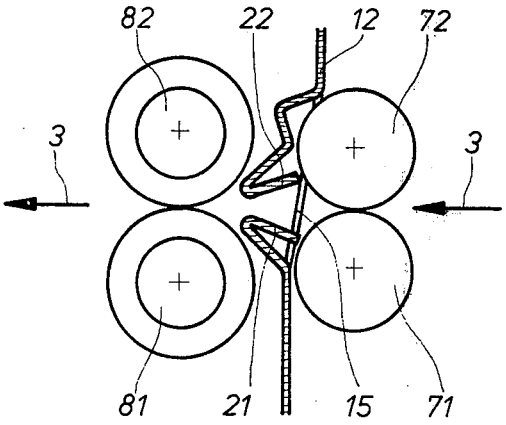
FIGS. 4 to 8 are diagrammatic side elevations showing further examples of noise emission sealing sites.

In the embodiment shown in FIG. 7, the guide members 21, 22 are formed by angulated terminal portions on the side of the discharge slot 15 of the vertical section 12 of cover plate 10, the folded edges being disposed in the immediate vicinity of folding rolls 71, 72 for the purpose of forming a plurality of noise emission seals.

Figure 8:
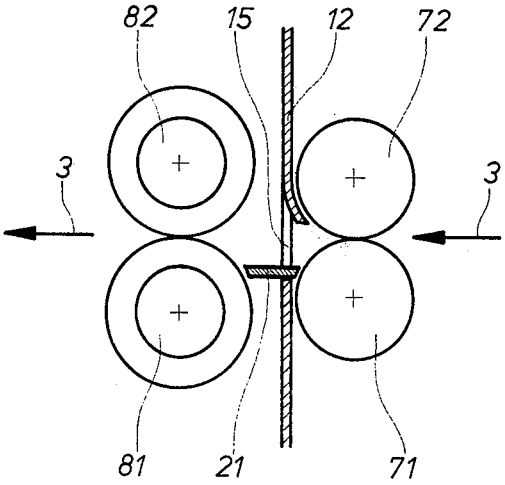

In the embodiment shown in FIG. 8, only the lower longitudinal edge of discharge slot 15 is provided with a guide member 21, the end faces of which are disposed in the immediate vicinity of lower folding roll 21 and lower knife shaft 81, respectively. The upper edge is formed by a curved portion of the cover plate section 12 which follows the curvature of the peripheral surface of upper folding roll 72 for the purpose of constituting a noise emission sealing surface.

What is claimed is:

1. A device for reducing the emission of noise in buckle folding units provided with noise control enclosures, comprising a noise control hood essentially completely enclosing the upper and lower folding pockets and the folding rolls, said noise control hood being at least partially slidingly displaceable, tiltable and/or removable and being provided with a slot for the passage of the sheet in the associated hood section, which slot is aligned with the nip of the pair of intake and discharge rolls, respectively, characterized in that the hood section associated with the pair of discharge rolls (71, 72) comprises a cover plate (10) having a vertical first section (12) secured to the hood and a second section (11) held on the first section (12) pivotably between an inclined closed position adjoining to the hood and an opened position above the folding rolls (7), wherein the longitudinal edges, being parallel to the roll axes, of the discharge slot (15) provided in the vertical section (12) are arranged such as to form noise emission sealing sites in cooperation with the peripheral surfaces of the pair of discharge rolls (71, 72).

2. The device according to claim 1, characterized in that at least one longitudinal edge of the discharge slot (15) is provided with a guide member (21, 22) for forming the noise emission sealing site.

3. The device according to claim 2, characterized in that the guide member (21, 22) is adapted to be slid onto the longitudinal edge of the discharge slot (15).

* * * * *